US005336101A

United States Patent [19]

Kasugai et al.

[11] Patent Number: 5,336,101

[45] Date of Patent: Aug. 9, 1994

[54] CONNECTOR ASSEMBLY

[75] Inventors: Masakuni Kasugai, Mie; Hisao Ito, Tochigi, both of Japan

[73] Assignee: Sumitomo Wiring Systems, Ltd., Mie, Japan

[21] Appl. No.: 51,267

[22] Filed: Apr. 23, 1993

Related U.S. Application Data

[63] Continuation of Ser. No. 795,029, Nov. 20, 1991, abandoned.

[30] Foreign Application Priority Data

Nov. 27, 1990 [JP] Japan ..... 2-125955[U]

[51] Int. Cl.[5] ..... H01R 13/52

[52] U.S. Cl. ..... 439/272; 439/273

[58] Field of Search ..... 439/271-283, 439/587

[56] References Cited

U.S. PATENT DOCUMENTS 4,521,064 6/1985 Knapp et al. ..... 439/271
4,621,883 11/1986 Noguchi ..... 439/271
4,857,007 8/1989 Michaels et al. ..... 439/273
4,917,620 4/1990 Samejima ..... 439/272
5,015,195 5/1991 Piriz ..... 439/318

*Primary Examiner*—David L. Pirlot
*Attorney, Agent, or Firm*—Sughrue, Mion, Zinn, Macpeak & Seas

[57] ABSTRACT

A connector assembly comprises a male connector in which a projection is provided on a male terminal housing in such a manner as to protrude in a direction normal to its connecting direction, and a female connector in which an engagement portion that is to be brought into engagement with the projection is provided on a female terminal housing having a portion over which the male terminal housing is fitted and an insertion restricting portion for the male terminal housing. There is provided a slight amount of gap between the projection and the engagement portion when the male terminal housing is inserted to the insertion restricting portion of the female terminal housing. An elastic body that is wider than the gap is interposed between the insertion restricting portion and the male terminal housing.

4 Claims, 4 Drawing Sheets

CONNECTOR ASSEMBLY

This is a continuation of application Ser. No. 07/795,029 filed Nov. 20, 1991 abandoned.

BACKGROUND OF THE INVENTION (1) Field of the Invention

The present invention relates to a connector for use in an automobile or the like to connect wiring harnesses, and more particularly to a connector assembly that is free from looseness in a state in which male and female connectors are coupled together.

(2) Statement of the Prior Art

FIG. 6 shows one example of connector assemblies for connecting wiring harnesses. FIG. 6 is a longitudinal sectional view of a conventional connector assembly in which connectors are assembled and coupled together.

As shown in the diagram, a male connector 50 has a projection 53 provided on a male terminal housing in which a male terminal 52 is installed in such a manner as to protrude in a direction normal to its connecting direction, while a female connector 60 has a female terminal 63 and a locking arm 64, adapted to be brought into engagement with the projection 53, provided on a female terminal housing 61. The female terminal having 61 has a portion 62 over which the male terminal housing 51 is fitted and a portion 62*a* for restricting the insertion of the male terminal housing 51.

In order to ensure a proper engagement of the projection 53 and locking arm 64 when the two connectors 50, 60 are coupled together, there is provided a narrow gap X between the projection 53 and locking arm 64 when the male terminal housing 51 is inserted as far as the portion 62*a* provided on the female housing 61 for restricting the insertion of the male terminal housing 51.

Due to this, when this connector assembly is used as a connector that is directly connected to an engine producing severe vibrations, the male and female connectors 50, 60 are caused to slide relative to each other within the distance of the gap X by virtue of vibrations generated in the connecting direction. This produces looseness, which in turn causes a slight sliding wear of the terminals 52, 63, thereby causing a risk of connection failure between the terminals 52, 63.

SUMMARY OF THE INVENTION

An object of the present invention is to provide a connector assembly that ensures proper locking of male and female connectors without any looseness when the two connectors are coupled together.

In order to achieve the above object, the present invention provides a connector assembly employing a construction in which an elastic body that is wider than a gap is interposed between the insertion restricting portion and the male terminal housing.

In the connector assembly constructed as described above, when the male terminal housing is fitted on the portion of the female terminal housing over which the male housing is to be fitted and is then pushed further thereover, the male terminal housing comes into abutment with the elastic body, then proceeds to a position where the projection comes into engagement with the engagement portion while compressing the elastic body for locking. In a locked state, the male terminal housing is forced rearward by virtue of the restoring force of the elastic body. Accordingly, there is no gap between the projection and the engagement portion.

DETAILED DESCRIPTION OF THE PREFERRED EMBODIMENTS

Figure 1:
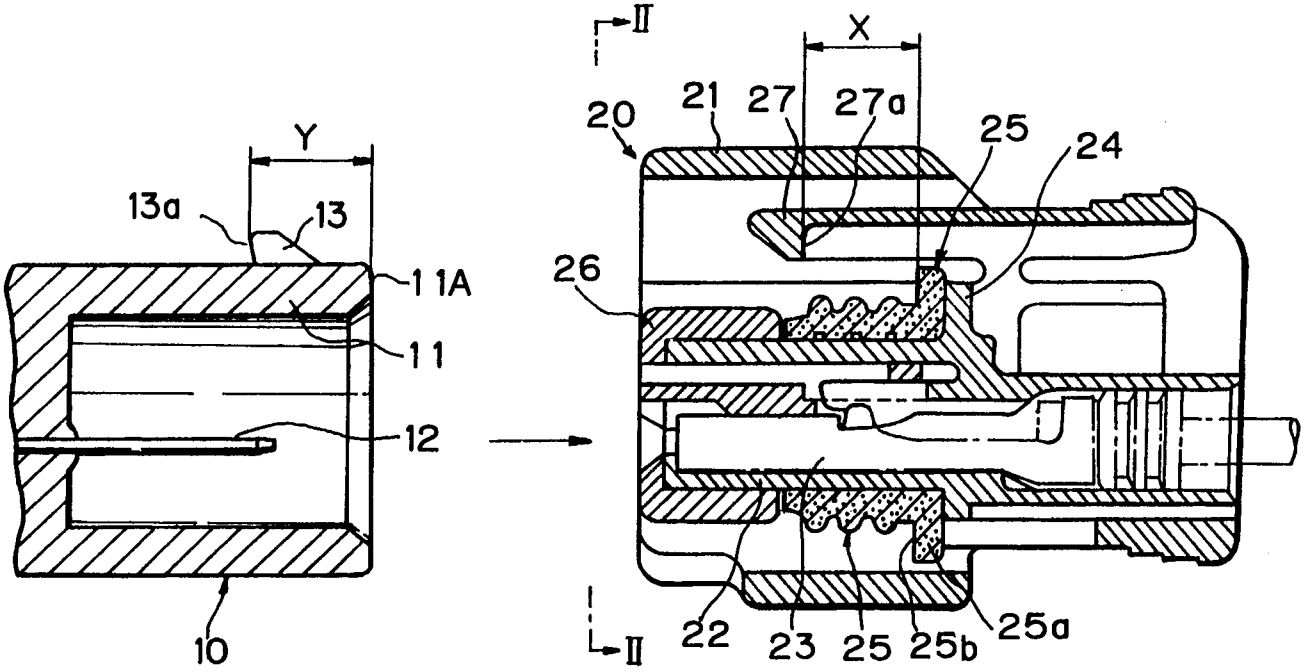
FIG. 1 is a longitudinal sectional view of a connector assembly, which is disassembled, according to the present invention.
Figure 2:
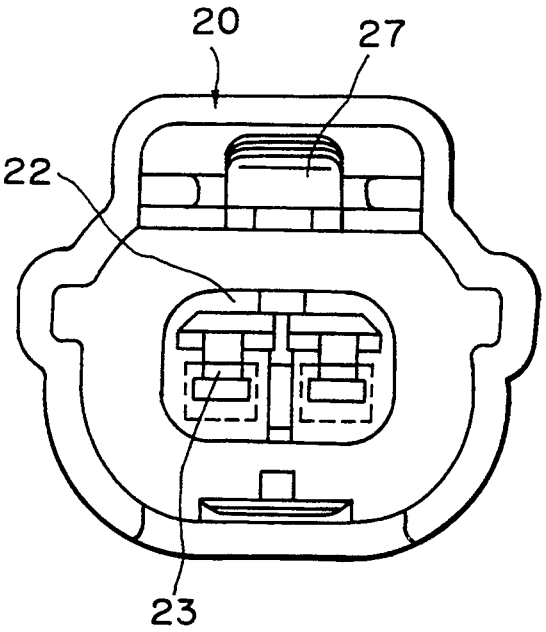
FIG. 2 is an end view as seen from the line II—II of FIG. 1.

Referring to the drawings, embodiments of the present invention will be described. As shown in FIGS. 1 and 2, in a male connector 10 of a connector assembly according to an embodiment of the present invention, the leading end portion of a male terminal housing 11 is formed in a tubular fashion, and a male terminal 12 is installed therein. In addition, a projection 13 is provided on the external surface of the male terminal housing 11 in such a manner as to protrude in a direction normal to its connecting direction.

In a female connector 20, an inner tubular portion 22 is formed inside a female terminal housing 21, and a female terminal 23 is installed therein. In addition, a flange portion 24 protruding outwardly is formed at the rear end portion of the inner tubular portion 22 so as to function as an insertion restricting portion for the male terminal housing 11. A rubber ring 25 and a retaining member 26 for the rubber ring 25 are fitted and secured over the inner tubular portion 22 from the leading end side thereof, thereby constituting a portion over which the male terminal housing 11 is fitted.

Furthermore, a locking arm 27 is provided on the female terminal housing 21 so as to be brought into engagement with the projection 13 of the male terminal housing 11 for locking of the female and male connectors 10, 20. This locking arm 27 is designed to come into and out of engagement with the projection by virtue of the elastic deformation of resin used.

Figure 3:
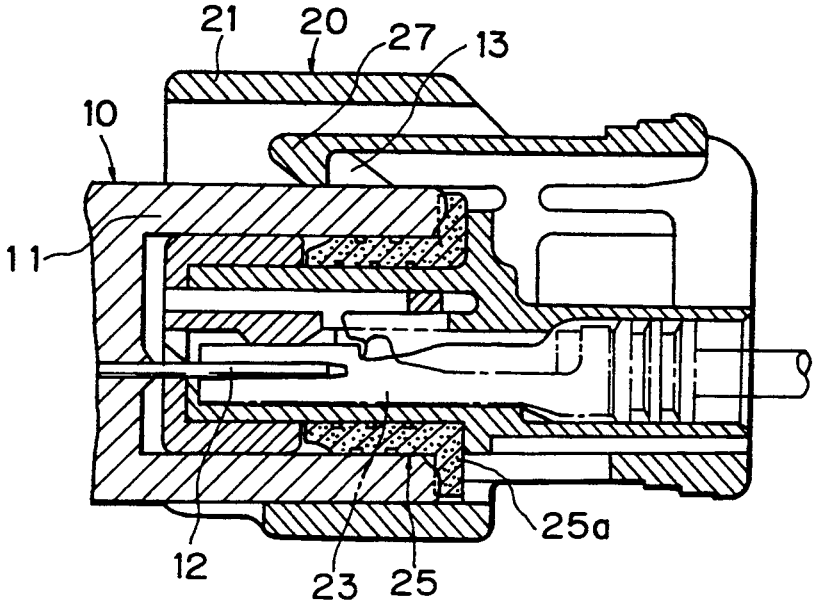
FIG. 3 is a longitudinal sectional view illustrating a state in which the connector assembly shown in FIG. 1 is assembled and coupled together.

The rubber ring 25 has at the rear end portion thereof a flange portion 25*a* that comes into abutment with the flange portion 24, and when the male terminal housing 11 is fitted over, the end face of the housing is brought into abutment with the flange portion 25*a* (FIG. 3). A distance X between an end face 25*b* of the flange portion 25*a* and an engaging face 27*a* of the locking arm 27 is formed such that it becomes slightly shorter than a distance Y between an end face 11*a* of the male terminal housing 11 and an engaging face 13*a* of the projection 13.

Therefore, when the female and male connectors 10, 20 are coupled together, the end face 11*a* of the male terminal housing 11 presses the flange portion 25*a* of the rubber ring 25, and when the flange portion 25*a* is deformed to a predetermined amount, the projection 13 and locking arm 27 are brought into engagement with each other, whereby the female and male connectors 10, 20 are securely locked together. In addition, in a locked state, as shown in FIG. 3, the male terminal housing 11 is forced back by virtue of the restoring force of the flange portion 25*a*, thereby no gap is produced in the portion where the projection 13 and the locking arm 27 are in engagement with each other.

Figure 4:
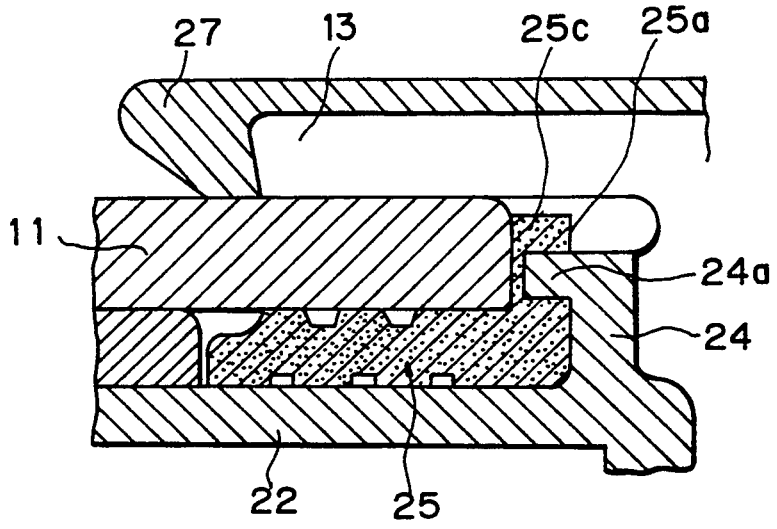
FIG. 4 is a partially enlarged sectional view showing another embodiment of the connector assembly according to the present invention.
Figure 5:
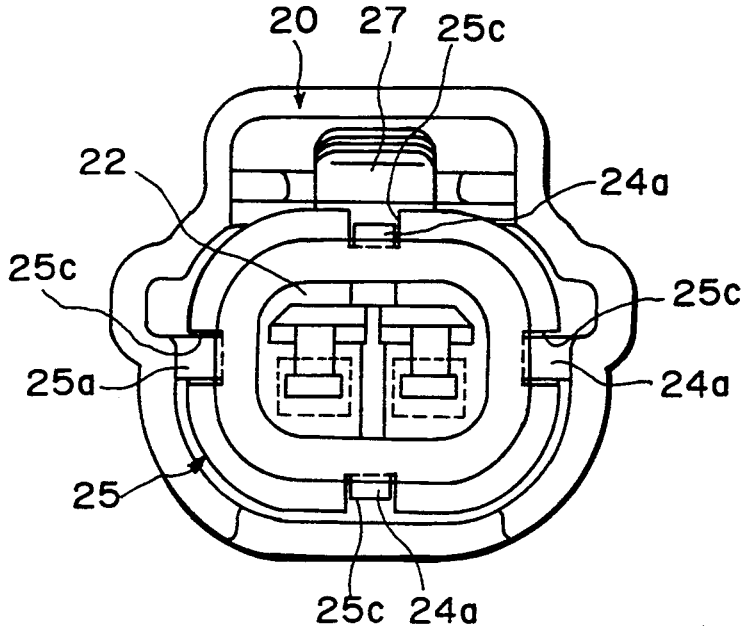
FIG. 5 is a whole end view of the connector assembly of FIG. 4.
Figure 6:
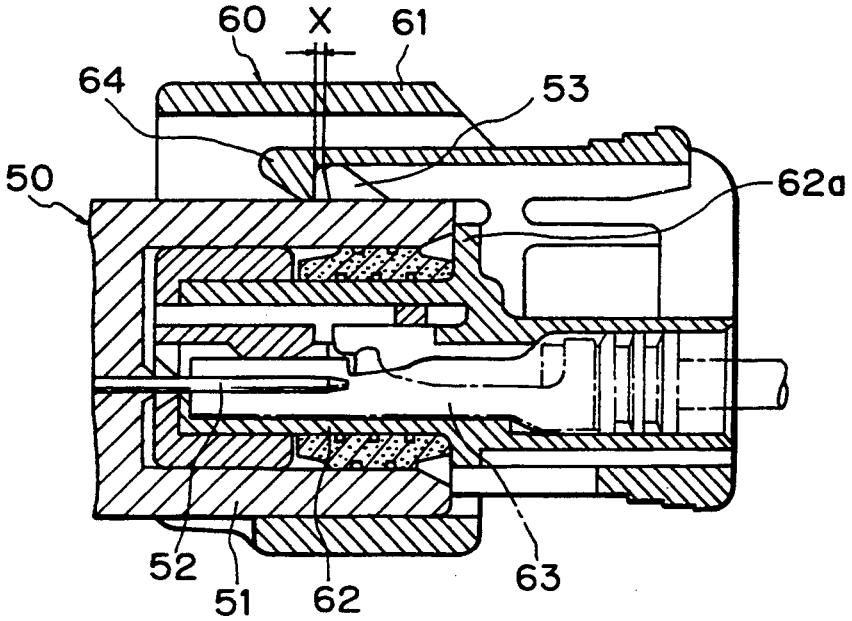
Fig. 6 PRIOR ART
FIG. 6 is a longitudinal sectional view of a conventional connector assembly.

FIGS. 4 and 5 show another embodiment of the present invention.

A connector assembly according to this embodiment has substantially the same construction as that of the connector assembly of the afore-mentioned embodiment. Therefore, only the difference will be described.

As shown in those diagrams, notched portions 25*c* are partially formed in the flange portion 25*a* of the rubber ring 25, and projections 24*a* are provided on the flange portion 24 of the inner tubular portion 22 so as to fit in the notched portions 25*c*. These projections 24*a* are intended to determine a distance over which the male terminal housing 11 is forcibly inserted, and the protruding distance of the projections 24*a* is set such that a difference between the thickness of the flange portion 25*a* and itself corresponds to a minimum gap required for engagement of the projection 13 and locking arm 27.

Consequently, when the female and male connectors 10, 20 are coupled together, an excessive insertion of the male connector 10 is prevented, and there is less risk of producing looseness. Moreover, deterioration of the flange portion 25*a* of the rubber ring 25 is minimized.

As described above, in the connector assembly of the present invention, since the construction is employed in which the elastic body that is wider than a gap required for the engagement of the projection and engagement portion is interposed between the insertion restricting portion of the female terminal housing and the male terminal housing, when the female and male connectors are put together for coupling, a required gap can be secured. Once the two connectors are coupled together, the male terminal housing is forced back by virtue of the restoring force of the elastic body thereby eliminating the gap between the projection and the engagement portion.

Due to this, even if the connector assembly of the present invention is used as a connector assembly that is connected to an engine producing severe vibrations, there is no risk of the female and male connectors being caused to slide relative to each other, and no looseness results therebetween. Consequently, the generation of a contact failure due to a slight sliding wear of terminals can be prevented.

What is claimed is:

1. A connector assembly, comprising:

a first connector;

a first engagement portion formed on said first connector;

a second connector;

a second engagement portion formed on said second connector;

a first support surface being formed on said first connector;

a second support surface being formed on said second connector; and an elastic member comprising a tubular first portion extending along an insertion axis of said assembly, and a flanged second portion extending from said first portion at a right angle to said first portion, said second portion being in contact with both of said first and second support surfaces, which are opposed to each other when said first and second connectors are assembled in a mating condition;

said first connector slidable into said second connector so as to press said second portion between said first and second support surfaces, a maximum advancement position of said first connector into said second connector being limited by said second portion of said elastic member.

2. A connector assembly as claimed in claim 1, wherein a gap is formed between said first and second engagement portions when said first connector is in said maximum advancement position, said elastic member being wider than said gap.

3. A connector assembly as claimed in claim 1, wherein one of said first and second support surfaces comprises projections formed on a respective one of said first and second connectors, said projections fit into recesses formed on said elastic member.

4. A connector assembly as claimed in claim 1, wherein said elastic member further comprises a third portion extending from an end of said second portion which is remote from said first portion in a direction which is parallel to said insertion axis.

* * * * *